US009166322B2

(12) United States Patent
Glick et al.

(10) Patent No.: US 9,166,322 B2
(45) Date of Patent: Oct. 20, 2015

(54) FEMALE ELECTRIC TERMINAL WITH GAP BETWEEN TERMINAL BEAMS

(71) Applicant: Lear Corporation, Southfield, MI (US)

(72) Inventors: Michael Glick, Farmington Hills, MI (US); Slobodan Pavlovic, Novi, MI (US); David Menzies, Linden, MI (US); Brantley Natter, Southfield, MI (US)

(73) Assignee: Lear Corporation, Southfield, MI (US)

( * ) Notice: Subject to any disclaimer, the term of this patent is extended or adjusted under 35 U.S.C. 154(b) by 45 days.

(21) Appl. No.: 14/169,216

(22) Filed: Jan. 31, 2014

(65) Prior Publication Data

US 2014/0227915 A1 Aug. 14, 2014

Related U.S. Application Data

(60) Provisional application No. 61/762,552, filed on Feb. 8, 2013.

(51) Int. Cl.

| | |
|---|---|
| ***H01R 4/48*** | (2006.01) |
| ***H01R 13/11*** | (2006.01) |
| ***H01R 13/18*** | (2006.01) |
| *H01R 101/00* | (2006.01) |

(52) U.S. Cl.
CPC ..... *H01R 13/113* (2013.01); *H01R 13/18* (2013.01); *H01R 2101/00* (2013.01)

(58) Field of Classification Search
CPC ..... H01R 13/18; H01R 13/68
USPC ..... 439/839, 857, 620.26, 250
See application file for complete search history.

(56) References Cited

U.S. PATENT DOCUMENTS

| | | | | |
|---|---|---|---|---|
| 2,774,951 | A | | 12/1956 | Kinkaid et al. |
| 2,921,287 | A | | 1/1960 | Matthysse et al. |
| 3,550,069 | A | | 12/1970 | Teagno |
| 4,553,799 | A | * | 11/1985 | Deters ..... 439/507 |
| 4,553,808 | A | | 11/1985 | Weidler et al. |
| 4,570,147 | A | | 2/1986 | Ebi |
| 4,583,812 | A | | 4/1986 | Gross, Jr. et al. |
| 4,646,052 | A | | 2/1987 | Matsunaga et al. |
| 4,672,352 | A | | 6/1987 | Takano |
| 4,751,490 | A | | 6/1988 | Hatagishi |
| 4,842,534 | A | | 6/1989 | Mobley et al. |
| 4,869,972 | A | | 9/1989 | Hatagishi |
| 4,871,990 | A | | 10/1989 | Ikeda et al. |
| 4,941,851 | A | | 7/1990 | Hsueh |
| 4,958,426 | A | | 9/1990 | Endo et al. |
| 5,007,865 | A | * | 4/1991 | Jakobeit ..... 439/839 |
| 5,088,940 | A | | 2/1992 | Saito |
| 5,147,230 | A | | 9/1992 | Plyler et al. |
| 5,226,842 | A | | 7/1993 | Endo et al. |
| 5,350,321 | A | | 9/1994 | Takenouchi |

(Continued)

FOREIGN PATENT DOCUMENTS

| | | |
|---|---|---|
| JP | 09-147731 | 6/1997 |
| JP | 2000-133114 | 12/2000 |

*Primary Examiner* — Phuongchi T Nguyen
(74) *Attorney, Agent, or Firm* — MacMillan, Sobanski & Todd, LLC

(57) ABSTRACT

A female electric terminal assembly includes a body, a first beam extending from the body, and a second beam extending from the body. A channel is defined between the first beam and the second beam. A clamp is attached to the body and applies a force to bias the first beam and the second beam into the channel. A gap is maintained between the first beam and the second beam.

12 Claims, 3 Drawing Sheets

(56) References Cited

U.S. PATENT DOCUMENTS

| | | | |
|---|---|---|---|
| 5,416,461 | A | 5/1995 | Totsuka et al. |
| 5,427,552 | A | 6/1995 | Zielinski et al. |
| 5,474,475 | A | 12/1995 | Yamaguchi |
| 5,488,346 | A | 1/1996 | Kondo et al. |
| 5,581,225 | A | 12/1996 | Oh et al. |
| 5,658,174 | A | 8/1997 | Benes et al. |
| 5,662,487 | A | 9/1997 | Okamura et al. |
| 5,679,034 | A | 10/1997 | Hanazaki et al. |
| 5,716,245 | A | 2/1998 | Kameyama et al. |
| 5,739,741 | A | 4/1998 | Hanazaki et al. |
| 5,745,024 | A | 4/1998 | Ohta et al. |
| 5,795,193 | A | 8/1998 | Yang |
| 5,886,611 | A | 3/1999 | Schaller et al. |
| 6,126,495 | A | 10/2000 | Lolic et al. |
| 6,178,106 | B1 | 1/2001 | Umemoto et al. |
| 6,431,880 | B1 | 8/2002 | Davis et al. |
| 6,506,060 | B2 | 1/2003 | Sumida et al. |
| 6,558,198 | B2 | 5/2003 | Kobayashi et al. |
| 6,759,938 | B2 | 7/2004 | Matsumura et al. |
| 6,824,430 | B2 | 11/2004 | Matsumura et al. |
| 7,071,808 | B2 | 7/2006 | Nakamura |
| 7,592,892 | B2 | 9/2009 | Ito et al. |
| 7,595,715 | B2 | 9/2009 | Pavlovic et al. |
| 7,612,647 | B2 | 11/2009 | Onoda et al. |
| 7,766,706 | B2 | 8/2010 | Kawamura et al. |
| 7,892,050 | B2 | 2/2011 | Pavlovic et al. |
| 8,182,299 | B2 | 5/2012 | Schrader |
| 2004/0124963 | A1 | 7/2004 | Nakamura |
| 2006/0205267 | A1 | 9/2006 | Darr et al. |
| 2008/0224814 | A1 | 9/2008 | Pavlovic et al. |
| 2011/0076901 | A1 | 3/2011 | Glick et al. |

* cited by examiner

FEMALE ELECTRIC TERMINAL WITH GAP BETWEEN TERMINAL BEAMS

CROSS-REFERENCE TO RELATED APPLICATIONS

This application claims the benefit of U.S. Provisional Application No. 61/762,552, filed Feb. 8, 2013, the disclosure of which is incorporated herein by reference.

BACKGROUND OF THE INVENTION

The present invention relates in general to an electrical terminal and, more specifically, to a female electrical terminal designed for controlling the force required to insert a corresponding male terminal.

Electrical connectors may be used in automobiles, for example, in completing electrical circuits with components in a power distribution box or connecting a wiring harness to an electrical device. These connectors may include a female terminal and a corresponding male terminal. The female terminal includes opposed beams that are biased into engagement with the male blade. The female terminal is typically made from a material having desirable electrical conductivity, such as copper. Additionally, the female terminal may include a spring feature that helps bias the beams into engagement with the blade in order to maintain strong contact between the female terminal and the male terminal. By biasing the beams into engagement with the blade, the amount of force required to insert the male blade between the beams is increased. It would be advantageous to have a female electrical terminal that allows greater control over the magnitude of the required insertion force while still maintaining strong contact between the female terminal and the male terminal.

SUMMARY OF THE INVENTION

This invention relates to a female electric terminal assembly. The female electric terminal assembly includes a body. A first beam extends from the body. A second beam extends from the body. A channel is defined between the first beam and the second beam. A clamp is attached to the body. The clamp applies a force to bias the first beam into the channel. The clamp applies a force to bias the second beam into the channel. A gap is maintained between the first beam and the second beam.

This invention further relates to a female electric terminal assembly. The female electric terminal assembly includes a body. A first beam extends from the body to a first beam end. A second beam extends from the body to a second beam end. A clamp biases the first beam and the second beam in an inward direction into the channel. The first beam extends from the first beam end in the inward direction to a contact area. The contact area is the portion of the first beam that is closest to the second beam. The first beam extends from the contact area in an outward direction to the body. The first beam does not contact the second beam at the contact area.

This invention further relates to a female electric terminal assembly. The female electric terminal assembly includes a terminal base. The terminal base is made of a first electrically-conductive material. The terminal base includes a body. A first beam extends from the body. A second beam extends from the body to define a channel between the first beam and the second beam. The first beam and the second beam extend from the body in an inward direction to respective contact areas. The first beam and the second beam extend from the contact areas in an outward direction that is opposite the inward direction to respective beam ends. A clamp is attached to the terminal base. The clamp made of a second electrically-conductive material that is a different material than the first electrically-conductive material. The clamp applies a force to bias the first beam into the channel. The clamp applies a force to bias the second beam into the channel. The first beam and the second beam are in respective rest positions relative to the body before the clamp is attached to the terminal base and the first beam and the second beam are separated by a rest width. The first beam and the second beam are in respective clamped positions relative to the body when the clamp is attached to the terminal base and are separated by a clamped width. The clamped width is less than the rest width. A gap is maintained between the first beam and the second beam.

Various aspects of this invention will become apparent to those skilled in the art from the following detailed description of the preferred embodiment, when read in light of the accompanying drawings.

DETAILED DESCRIPTION OF THE PREFERRED EMBODIMENT

Figure 1:
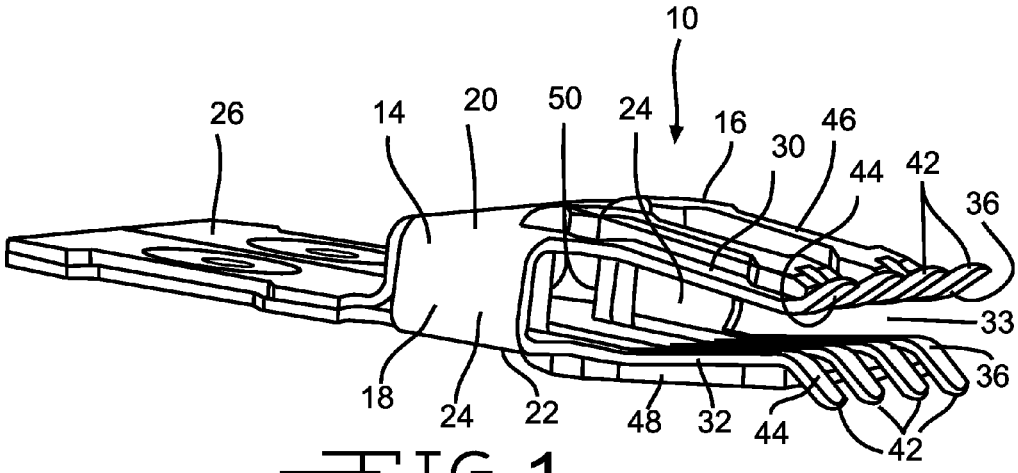
FIG. 1 is a perspective view of a female electric terminal assembly.
Figure 3:
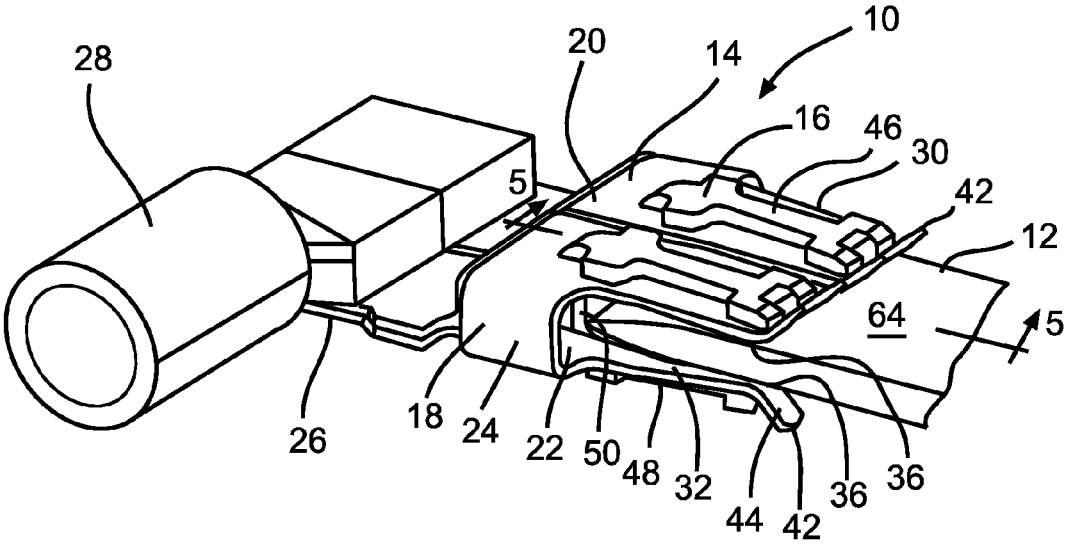
FIG. 3 is a perspective view similar to FIG. 2, showing the male blade terminal mated with the female electric terminal assembly.

Referring to the drawings, there is shown in FIG. 1 a female electric terminal assembly, indicated generally at 10. The female electric terminal assembly 10 is configured to mate with a corresponding male blade terminal 12, as shown in FIG. 3, to create an electrical connection. The female electric terminal assembly 10 and the male blade terminal 12 may be enclosed in respective housings (not shown) and are suitable for use in situations in which it is desirable to have a separable electrical connection. Referring back to FIG. 1, the female electric terminal assembly 10 includes a terminal base 14 and a clamp 16.

The terminal base 14 is made of an electrically-conductive material, such as copper, or aluminum, but the terminal base 14 may be made of any other desired material. The illustrated terminal base 14 is made from a single piece of sheet metal stamped and folded into the illustrated shape. However, the terminal base 14 may be made from more than one piece of material and may be made by any desired method. Further, the particular shape of the terminal base 14 may be different from that illustrated, if desired.

Figure 2:
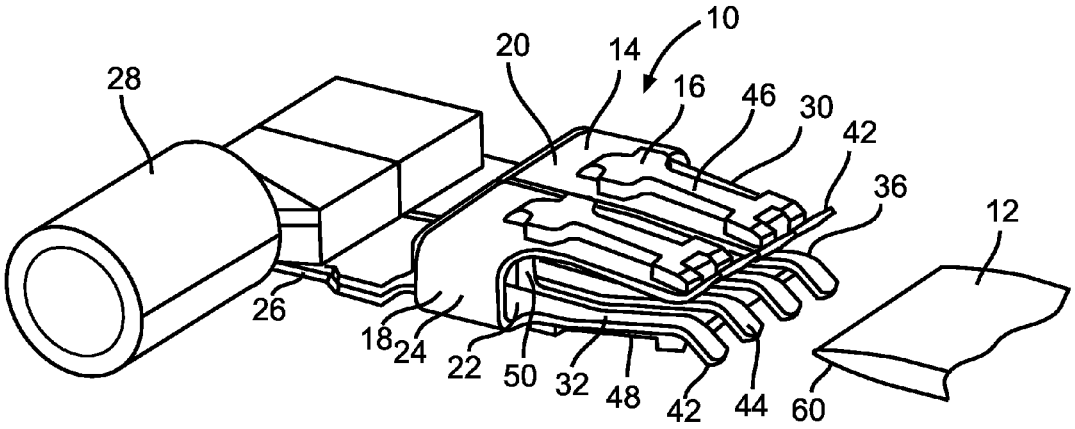
FIG. 2 is a perspective view of the female electric terminal assembly and a corresponding male blade terminal with a wire attached to the female electric terminal assembly.

The terminal base 14 includes a body 18. The body 18 has a generally rectangular box shape including a first side 20 and a spaced-apart second side 22. The first side 20 and the second side 22 are connected by two side walls 24. A termination area 26 extends from the body 18. As shown in FIG. 2 and FIG. 3, an electrically-conductive wire 28 is attached to the termination area 26. The terminal base 14 also includes a plurality of first beams 30 that extend from the first side 20 of the body 18 and a plurality of second beams 32 that extend from the second side 22 of the body 18. The first beams 30 and the second beams 32 define a channel 33 there between. The first beams 30 and the second beams 32 extend from the body 18 on opposed sides of a connection plane 34 (best seen in FIG. 4, FIG. 5, and FIG. 6). The connection plane 34 is located in the channel 33 and corresponds to the position of the male blade terminal 12 when the male blade terminal 12 is mated with the female electric terminal assembly 10.

The first beams 30 and the second beams 32 extend from the body 18 in opposed pairs, with one member of each pair on each side of the connection plane 34. However, this is not necessary and the first beams 30 and the second beams 32 may have any other desired arrangement that allows them to mate with the corresponding male blade terminal 12.

Each of the first beams 30 and second beams 32 includes a contact area 36. As the first beams 30 and the second beams 32 extend from the body 18, they extend in an inward direction 38 (see FIG. 4, FIG. 5, and FIG. 6) toward the connection plane 34 up to the contact area 36. The first beams 30 and second beams 32 extend past the contact area 36 and extend in an outward direction 40 (see FIG. 4, FIG. 5, and FIG. 6) away from the connection plane 34 to respective beam ends 42.

Figure 6:
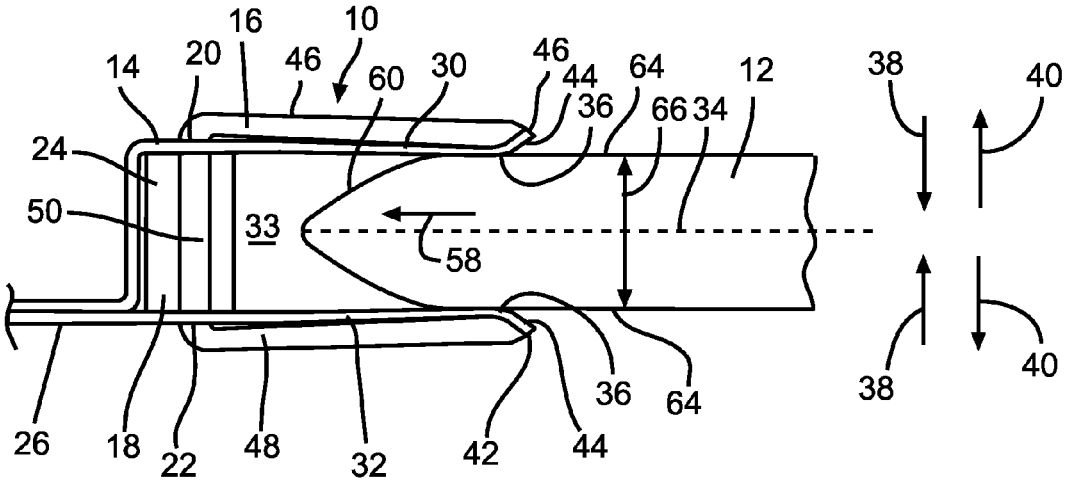
FIG. 6 is a cross-sectional view similar to FIG. 5, showing the female electric terminal assembly engaged with the male blade terminal.

The contact areas 36 are the portions of the first beams 30 and second beams 32 that are closest to the connection plane 34. The contact area 36 of a particular first beam 30 is also the portion of that first beam 30 that is closest to the respective paired second beam 32. The contact areas 36 are the portions of the first beams 30 and the second beams 32 that are in contact with the male blade terminal 12 when the male blade terminal 12 is mated with the female electric terminal assembly 10, as shown in FIG. 3 and FIG. 6.

Referring back to FIG. 1, each of the outwardly-extending portions of the first beams 30 and the second beams 32 between the contact areas 36 and the beam ends 42 defines an initial engagement surface 44. The initial engagement surface 44 is the portion of the respective first beam 30 or second beam 32 that the male blade terminal 12 first engages when the male blade terminal 12 is mated with the female electric terminal assembly 10, as will be described below.

The clamp 16 includes first clamp arms 46 on the first side 20 of the body 18 and second clamp arms 48 on the second side 22 of the body 18. The first clamp arms 46 and the second clamp arms 48 are connected by lateral portions 50 that extend through the body 18. The clamp 16 serves to bias the first beams 30 and the second beams 32 of the terminal base 14 in the inward direction 38, as is described below. The specific shape of the clamp 16 shown is only one embodiment, and the clamp 16 may have a different shape from that shown, if desired.

The clamp 16 is made of an electrically-conductive material, but may be made of any other desired material. The clamp 16 may be made of a different material than the terminal base 14. The illustrated clamp 16 is made of stainless steel. However, the clamp 16 may be made of any other desired material. The illustrated clamp 16 is made from a single piece of sheet metal stamped and folded into the illustrated shape. However, the clamp 16 may be made from more than one piece of material and may be made by any desired method. Further, the particular shape of the clamp 16 may be different from that illustrated, if desired. The clamp 16 serves to bias the first beams 30 and the second beams 32 into engagement of the male blade terminal 12. The first clamp arms 46 are disposed to engage the first beams 30 and bias the first beams 30 in the inward direction 38 toward the connection plane 34. Similarly, the second clamp arms 48 are disposed to engage the second beams 32 and bias the second beams 32 in the inward direction 38 toward the connection plane 34.

The design and operation of the clamp 16 is similar to the clamping member described in U.S. Pat. No. 7,892,050, the disclosure of which is incorporated herein by reference. However, in the female electric terminal 10 described herein, the first beams 30 do not engage the second beams 32, and a gap 56 is maintained between the first beams 30 and the second beams 32 of the terminal base 14 as shown in FIG. 5.

Figure 4:
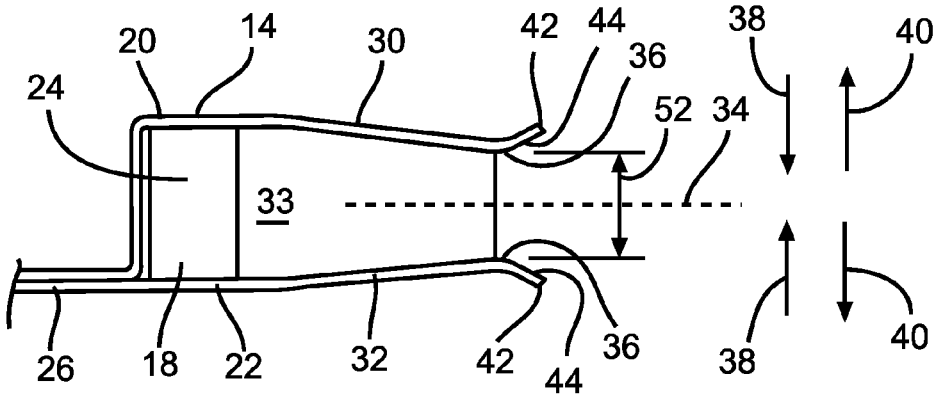
FIG. 4 is a cross-sectional view of a terminal base of the female electrical terminal assembly.

Referring to FIG. 4, a cross-section view of the terminal base 14 is shown without the clamp 16 attached. The first beams 30 and the second beams 32 are shown in respective rest positions relative to the body 18. As shown, there is a rest space between the contact area 36 of the first beams 30 and the contact area 36 of the second beams 32. The rest space has a rest width 52.

Figure 5:
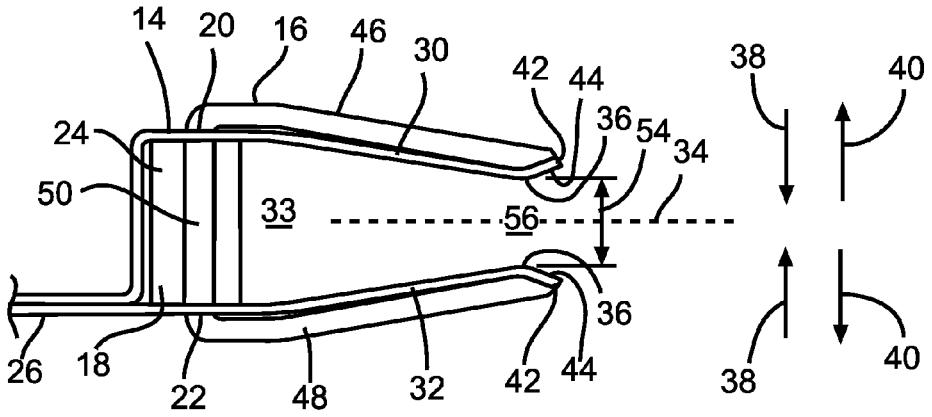
FIG. 5 is a cross sectional view similar to FIG. 4, taken along the line 5-5 of FIG. 3.

Referring to FIG. 5, a cross-sectional view similar to that of FIG. 4 is shown. The cross-sectional view shown in FIG. 5 is taken along line 5-5 of FIG. 3. As shown, the clamp 16 biases the first beams 30 and the second beams 32 in the inward direction 38 toward the connection plane 34. Therefore, the first beams 30 and the second beams 32 are pre-tensioned in the inward direction 38 by the clamp 16. The first beams 30 and the second beams 32 are in respective clamped positions relative to the body 18, and there is a clamped space between the contact area 36 of the first beams 30 and the contact area 36 of the second beams 32. The clamped space has a clamped width 54. The clamped width 54 is less than the rest width 52. However, the first beams 30 are not in contact with the second beams 32, and the gap 56 is maintained between the first beams 30 and the second beams 32. The illustrated gap 56 extends the full length of the first beams 30 and the second beams 32.

Referring to FIG. 6, a cross-sectional view similar to that of FIG. 5 is shown, with the male blade terminal 12 mated with the female electric terminal assembly 10. The initial engagement surfaces 44 are angled so that, from the beam ends 42, the first beam 30 and the second beam 32 angle in the inward direction 38 toward each other to the contact area 36. As previously described, the first beam 30 does not contact the second beam 32 at the contact area 36. Continuing toward the body 18 from the contact area 36, the first beam 30 and the second beam 32 angle in the outward direction 40 away from each other. When the male blade terminal 12 is inserted into the female electric terminal assembly 10 in an insertion direction 58, a leading end 60 of the male blade terminal 12 first engages the respective initial engagement surfaces 44 of the first beams 30 and the second beams 32. As a result of the relative angles of the leading end 60 and the initial engagement surfaces 44, some of the force pushing the male blade terminal 12 in the insertion direction 58 is redirected to push the first beams 30 and the second beams 32 in the outward direction 40. The first beams 30 and second beams 32 are pushed to respective engaged positions relative to the body 18, shown in FIG. 6. When the first beams 30 and the second beams 32 are in the engaged positions, they are separated by an engaged space with an engaged width 62. The engaged width 62 is at least equal to a width of the male blade terminal 12. It should be appreciated that in the illustrated embodiment, the first blades 30 and the second blades 32 are arranged in opposed pairs on opposite sides of the connection plane 34, and the engaged width 62 is equal to the width of the male blade terminal 12. However, the first blades 30 and the second blades 32 may be arranged different, for example with the second blade opposite a space between the first blades, so that the distance between the first beams 30 and the second beams 32 is greater than the thickness of the male blade terminal 12. In the illustrated embodiment, the engaged width 62 is greater than the rest width 52, but the engaged width 62 may be equal to or less than the rest width 52, if desired.

When the male blade terminal 12 is mated with the female electric terminal assembly 10, the female electric terminal assembly 10 applies a normal force (Fn) on the male blade terminal 12 in the inward direction 38. The components of the normal force (Fn) include a clamp force (Fc) applied by the clamp 16 and a base force (Fb) applied by the terminal base 14. As previously described, during assembly of the female electric terminal assembly 10, the first blades 30 and the second blades 32 are pre-tensioned in the inward direction 38 by the clamp 16. Thus, a pre-tensioning force (Ft) is applied to the first blades 30 and the second blade 32. The pre-tensioning force (Ft) is relieved when the first blades 30 and the second blades 32 are moved from the clamped positions (shown in FIG. 5) to the rest positions (shown in FIG. 4). The normal force (Fn) applied to the male blade terminal 12 may be calculated as:

$$Fn=Fc+Fb-Ft$$

When the male blade terminal 12 is mated with the female electric terminal assembly 10, sufficient force is applied in order to push the first beams 30 and the second beams 32 to the engaged position (shown in FIG. 6). It should be appreciated that the amount of force applied in the insertion direction 58 necessary to overcome the normal force will depend on the angle of the initial engagement surface 44 and the leading end 60. Once the first beams 30 and the second beams 32 are in the engaged positions, further movement of the male blade terminal 12 in the insertion direction 58 will be resisted by a frictional force between the contact area 36 and sides 64 of the male blade terminal 12. The magnitude of the frictional force is proportional to the normal force. It should be appreciated that the frictional force will also resist the male blade terminal 12 being removed from the female electric terminal assembly 10. There may be a desired maximum value of the normal force in order to limit the amount of force necessary to mate the male blade terminal with the female electric terminal assembly 10. Additionally, the normal force helps maintain positive contact between the terminal base 14 and the male blade terminal 12, and that contact is helpful in maintaining desired electrical conductivity between the two components. There may be a desired minimum value for the normal force in order to maintain sufficient contact between the terminal base 14 and the male blade terminal 12.

The design of the female electric terminal 10 allows the normal force to be selected based on factors including the spring characteristics of the terminal base 14, the spring characteristics of the clamp 16, and the relative size of the clamped width 54 and the engaged width 62. It should be appreciated that because the female electric terminal assembly 10 includes the gap 56, the first beams 30 and the second beams 32 do not have to travel as far to be moved from the clamped width 54 to the engaged width 62, as compared to a conventional female terminal.

The principle and mode of operation of this invention have been explained and illustrated in its preferred embodiment. However, it must be understood that this invention may be practiced otherwise than as specifically explained and illustrated without departing from its spirit or scope.

What is claimed is:

1. A female electrical terminal assembly comprising:
a terminal base including:
a body that is generally shaped in the form of a rectangular box having first and second opposed sides connected together by first and second side walls;
a plurality of first beams that extend from the first side of the body; and
a plurality of second beams that extend from the second side of the body; and
a clamp including:
a plurality of first clamp arms that engage the plurality of first beams of the terminal base;
a plurality of second clamp arms that engage the plurality of second beams of the terminal base; and
a lateral portion that extends through the body of the terminal base and connects the plurality of first clamp arms to the plurality of second clamp arms,
wherein the clamp biases the plurality of first beams of the terminal base and the plurality of second beams of the terminal base toward one another and maintains a gap therebetween.

2. The female electrical terminal assembly defined in claim 1 wherein the gap extends the full length through both the plurality of first beams and the plurality of second beams to the body of the terminal base.

3. The female electrical terminal assembly defined in claim 1 wherein a plurality of lateral portion extends through the body of the terminal base and connects the plurality of first clamp arms to the plurality of second clamp arms.

4. The female electrical terminal assembly defined in claim 1 wherein a lateral portion extends through the body of the terminal base and connects the each of plurality of first clamp arms to a respective one of the plurality of second clamp arms.

5. The female electrical terminal assembly defined in claim 1 wherein each of the plurality of first clamp arms extends from the first side of the body in an inward direction to respective first contact areas, and wherein each of the plurality of second clamp arms extends from the second side of the body in an inward direction to respective second contact areas.

6. The female electrical terminal assembly defined in claim 5 wherein each of the plurality of first clamp arms extends from the respective first contact areas in an outward direction to respective first beam ends, and wherein each of the plurality of second clamp arms extends from the respective second contact areas in an outward direction to respective second beam ends.

7. A combined female electrical terminal assembly and male blade assembly comprising:
(1) a female electrical terminal assembly including:
a terminal base including:
a body that is generally shaped in the form of a rectangular box having first and second opposed sides connected together by first and second side walls;
a plurality of first beams that extend from the first side of the body; and
a plurality of second beams that extend from the second side of the body; and
a clamp including:
a plurality of first clamp arms that engage the plurality of first beams of the terminal base;
a plurality of second clamp arms that engage the plurality of second beams of the terminal base; and
a lateral portion that extends through the body of the terminal base and connects the plurality of first clamp arms to the plurality of second clamp arms,
wherein the clamp biases the plurality of first beams of the terminal base and the plurality of second beams of the terminal base toward one another and normally maintains a gap defining a first dimension therebetween; and (2) a male blade extending within the gap and engaging the plurality of first beams of the terminal base and the plurality of second beams of the terminal base, the male blade defining a second dimension that is greater than the first dimension.

8. The female electrical terminal assembly defined in claim 7 wherein the gap extends the full length through both the plurality of first beams and the plurality of second beams to the body of the terminal base.

9. The female electrical terminal assembly defined in claim 7 wherein a plurality of lateral portion extends through the body of the terminal base and connects the plurality of first clamp arms to the plurality of second clamp arms.

10. The female electrical terminal assembly defined in claim 7 wherein a lateral portion extends through the body of the terminal base and connects the each of plurality of first clamp arms to a respective one of the plurality of second clamp arms.

11. The female electrical terminal assembly defined in claim 7 wherein each of the plurality of first clamp arms extends from the first side of the body in an inward direction to respective first contact areas, and wherein each of the plurality of second clamp arms extends from the second side of the body in an inward direction to respective second contact areas.

12. The female electrical terminal assembly defined in claim 7, wherein each of the plurality of first clamp arms extends from the respective first contact areas in an outward direction to respective first beam ends, and wherein each of the plurality of second clamp arms extends from the respective second contact areas in an outward direction to respective second beam ends.

* * * * *